US007028353B2

(12) United States Patent
Waldman et al.

(10) Patent No.: US 7,028,353 B2
(45) Date of Patent: Apr. 18, 2006

(54) ADJUSTABLE BED RAIL

(75) Inventors: Kenneth C. Waldman, Reading, PA (US); Jerome Drobinski, Reading, PA (US)

(73) Assignee: Simplicity, Inc., Reading, PA (US)

( * ) Notice: Subject to any disclaimer, the term of this patent is extended or adjusted under 35 U.S.C. 154(b) by 18 days.

(21) Appl. No.: 10/757,240

(22) Filed: Jan. 14, 2004

(65) Prior Publication Data

US 2004/0168251 A1 Sep. 2, 2004

Related U.S. Application Data

(60) Provisional application No. 60/440,006, filed on Jan. 14, 2003.

(51) Int. Cl.
*A47C 21/08* (2006.01)

(52) U.S. Cl. ..... 5/430; 5/426

(58) Field of Classification Search ..... 5/430, 5/426, 425, 427, 428, 429
See application file for complete search history.

(56) References Cited

U.S. PATENT DOCUMENTS

| | | | | |
|---|---|---|---|---|
| 1,760,346 | A * | 5/1930 | Correa | 24/72.5 |
| 2,071,155 | A * | 2/1937 | Samuel | 5/658 |
| 2,722,693 | A * | 11/1955 | Wolf | 5/426 |
| 4,833,743 | A | 5/1989 | Howell et al. | |
| 5,437,067 | A | 8/1995 | Bernstein et al. | |
| 5,463,784 | A | 11/1995 | Alpern | |
| 5,519,905 | A | 5/1996 | Bernstein et al. | |
| 5,640,726 | A | 6/1997 | Fichner-Rathus | |
| 6,134,731 | A | 10/2000 | Thom et al. | |
| 6,332,232 | B1 | 12/2001 | Neal | |
| 6,401,280 | B1 | 6/2002 | Baker | |
| 6,886,196 | B1 * | 5/2005 | Nygren et al. | 5/430 |
| 6,952,846 | B1 * | 10/2005 | Flannery et al. | 5/425 |
| 2004/0123387 | A1 * | 7/2004 | Marsden et al. | 5/426 |
| 2004/0211002 | A1 * | 10/2004 | Tomas et al. | 5/426 |

* cited by examiner

*Primary Examiner*—Alexander Grosz
(74) *Attorney, Agent, or Firm*—Volpe and Koenig, P.C.

(57) ABSTRACT

An adjustable bed rail capable of gripping a mattress either alone or together with a bedspring to hold the protective side rail in place. A locking assembly is adjustable to adjust for the height of the mattress either alone or together with the bedspring. Friction pads and/or friction surfaces may be mounted along the bed rail to further enhance the locking of the side rail to the mattress. The bed rail may be provided with a rail that drops down to facilitate climbing on to or off of the bed and can be locked into the upright position.

29 Claims, 7 Drawing Sheets

FIG. 2
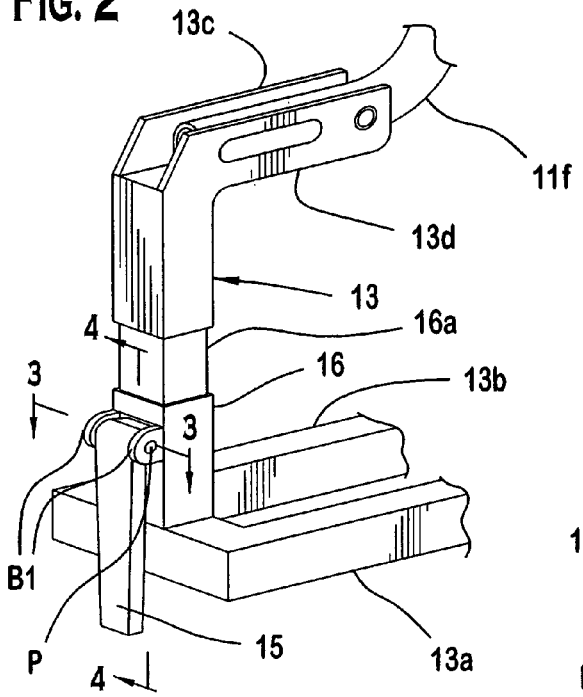
FIG. 3
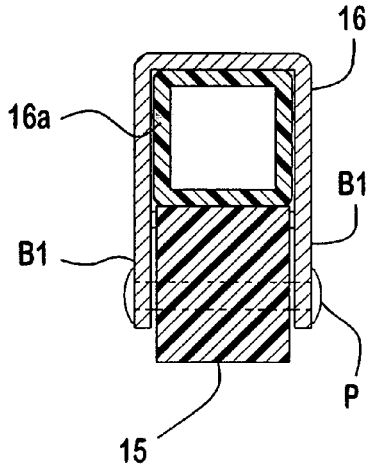
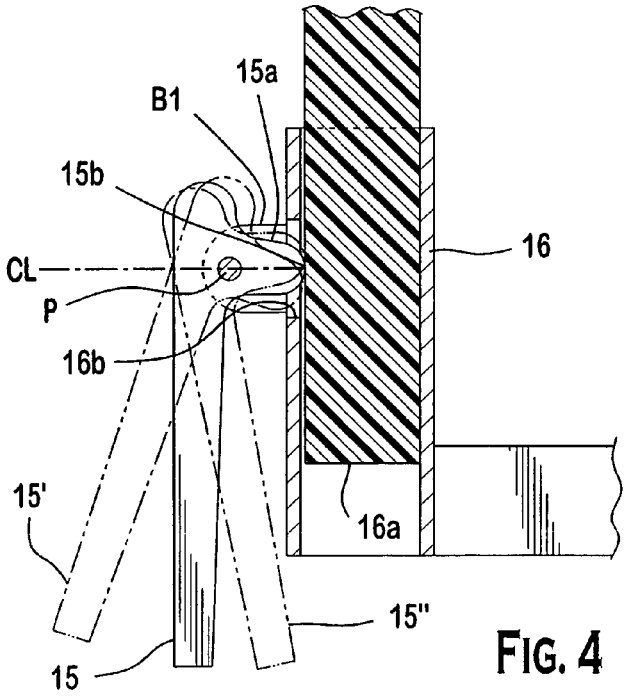
FIG. 4

FIG. 6
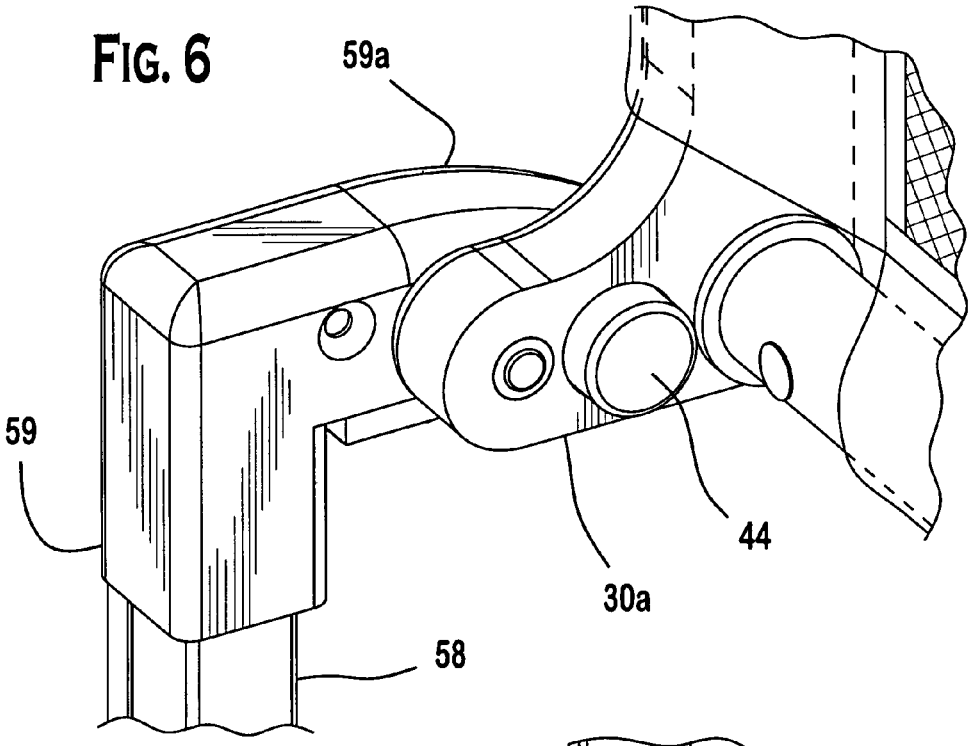
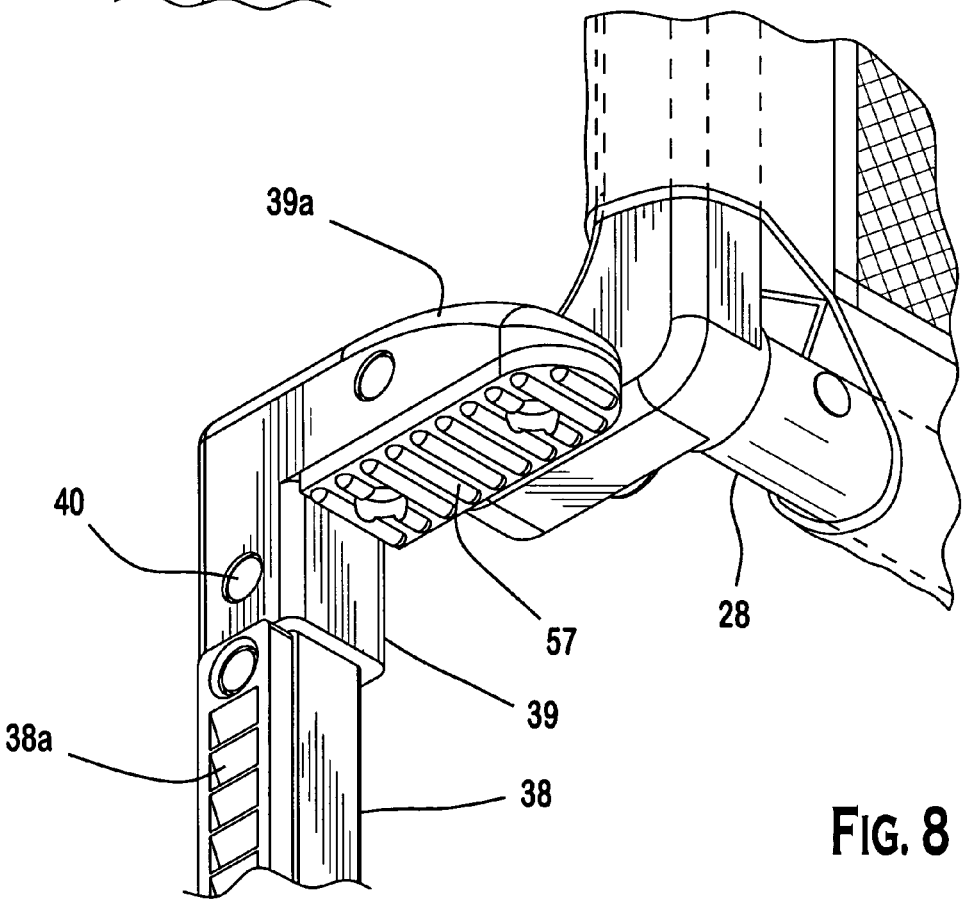
FIG. 8

ADJUSTABLE BED RAIL

CROSS REFERENCE TO RELATED APPLICATION(S)

This application claims priority from provisional application Ser. No. 60/440,006 filed on Jan. 14, 2003, which is incorporated by reference as if fully set forth.

FIELD OF INVENTION

The present invention relates to bed rails. More particularly the present invention relates to a bed rail assembly which is held to a child's bed in a manner so as to prevent dislodgement thereof.

BACKGROUND

Bed rails are typically utilized to protect children, elders, or injured persons from falling off a bed. The current technology of bed rails is quite basic in that most bed rails have either metal or plastic parts which protrude from the bed rail and are placed under the mattress and typically between the mattress and bedspring or between the mattress and other support. Traditional bed rails rely upon the friction between the mattress and the box spring to keep the bedrail in place. Quite often this is insufficient to retain the bed rail in place on the bed. It is therefore extremely advantageous to provide a bed rail which substantially avoids if not eliminates the danger of a bed rail slipping away from its intended position and use.

SUMMARY

An adjustable bed rail capable of squeezing a mattress either alone or together with a bedspring to lock the protective side rail in place. The locking means is adjustable to adjust for the height of the mattress either alone or together with the bedspring. Friction pads and/or surfaces mounted along surfaces of the bed rail engage the mattress to further enhance the locking of the side rail to the mattress. In one preferred embodiment the rail portion drops down when unlocked the facilitate climbing onto or off of the bed. The rail is adjustable in length to accommodate different bed lengths and different occupants.

BRIEF DESCRIPTION OF THE DRAWING(S)

The present invention will be understood from a consideration of the detailed description and drawings, wherein like elements are designated by like numerals and, wherein:

FIG. 2 is a perspective view of a latch assembly employed in the bed rail of FIG. 1.

FIG. 3 is a sectional view of the latch assembly looking in the direction of arrows 3—3 of FIG. 2.

FIG. 4 is a detailed, partially sectionalized view looking in the direction of arrows 4—4 of FIG. 2, of one embodiment of a latch assembly for adjusting the height of the bed rail to firmly grip the mattress.

FIGS. 6–8 are perspective views showing different views of the embodiment of FIG. 5 to facilitate an understanding of various aspects of the invention.

DETAILED DESCRIPTION OF PREFERRED EMBODIMENT(S)

Figure 1:
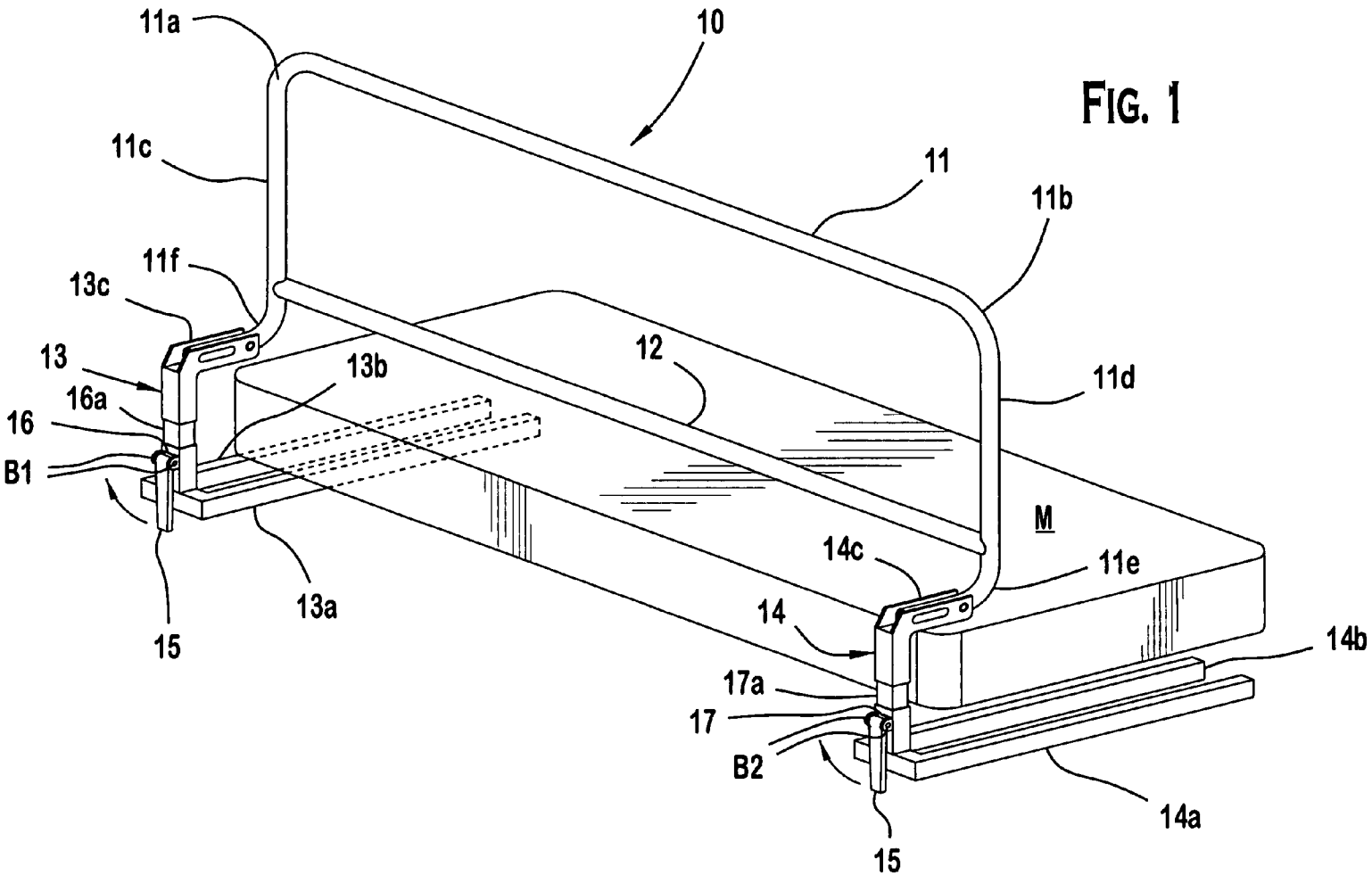
FIG. 1 is a perspective view showing a first embodiment of a bed rail designed in accordance with the principles of the present invention.

FIG. 1 shows a bed rail assembly 10 embodying the principles of the present invention, the upper rail portion protecting a person, i.e., an adult or a child, from falling off the bed and is comprised of two horizontal bars or tubes 11 and 12. Upper bar 11 is curved at 11*a* and 11*b* to form vertically aligned portions 11*c* and 11*d*. Tubular member 12 has its ends secured to the vertical portions 11*c*, 11*d* of member 11. If desired, additional horizontal bars may be placed above and/or below member 12. Also, the length (i.e. "height") of portions height 11*c* and 11*d* and the lengths of the bars 11 and 12 may be increased if desired without departing from the scope and spirit of the present invention. Members 11 and 12 are preferably formed of a suitable light-weight material such as tubular steel or aluminum or a suitable plastic. If desired, the members 11 and 12 may also be formed of wood or other solid material which is preferably light-weight and yet sturdy. Bar 11 also bends outwardly at 11*e* and 11*f* and extends into assemblies 13 and 14, respectively.

Each of the assemblies 13 and 14 has a pair of elongated, bifurcated arms 13*a*, 13*b* and 14*a*, 14*b* secured to the lower ends thereof. In addition thereto, each of the assemblies 13 and 14 has a movable, lockable end 16, 17, which is vertically aligned, each receiving one of the vertical arms 16*a*, 17*a*. These lockable arms 16*a* and 17*a* may be hollow or solid.

FIG. 2 is an enlarged view of the mattress holding portion of the bedrail of FIG. 1. FIG. 3 is a sectional view of FIG. 2 looking in the direction of arrows 3—3 and FIG. 4 is partially sectionized view of the structure of FIG. 2 looking in the directions of arrows 4—4 and further showing brackets B1 pivotally mounting locking arm 15 by means of a pivot pin P, only one assembly being described for purposes of simplicity. Hollow tubular member 16 has an opening 16*b* for receiving a projection 15*a* of the locking arm 15. As locking arm 15 is moved to dotted line position 15', the forward tip 15*b* of projection 15*a* moves away from opening 16*b*, enabling the arm 16*a* to be moved relative to tubular portion 16 to adjust to the height of a mattress M.

The arm 16*a* is positioned relative to tubular member 16 preferably so as to "squeeze" mattress M between the horizontal member 13*c* and bifurcated arms 13*a*, 13*b*. When the mattress M is adequately "squeezed," locking arm 15 is moved to the dotted line position 15". In this position, projection 15*a* enters into opening 16*b* and tip 15*b* of projection 15*a* thereof presses against an adjacent side of arm 16*a*. The tip 15*b* assumes an over-center position relative to center line CL. This over-center position is retained by the lower edge of the locking arm 15 to lock the arm 16*a* within hollow tubular member 16.

The assembly 14 operates in a substantially identical manner.

In order to further enhance the holding force applied to the mattress by the bed rail assembly 10, friction pads (not shown) may be placed on the underside 13*d*, 14*d* of horizontal members 13*c*, 14*c* and/or on the upper surface of arms 13*a*, 13*b* and 14*a*, 14*b*.

FIGS. 5–11 show a presently preferred embodiment 20 of the present invention which is comprised of a rail portion 22 and a supporting portion 24. The rail portion 22 is generally comprised of a pair of side posts 25, 26 and upper and lower cross pieces 27 and 28 coupled to the side posts at each corner thereof.

The supporting portion 24 is comprised of a pair of base members 33 and 34 which are substantially identical in design and function to one another and only one of these base members will be described herein for purposes of simplicity. The base member 33 has a portion 33*a* at its inner end extending into a hollow L-shaped bracket 35. Fastening member 36 extends therethrough to hold base member 33 pivotably in place. The opposite end 33*b* of base member 33 is of increased width and has an upper surface 33*c* provided with a V-shaped or sawtooth configuration to facilitate providing a firm grip upon a mattress.

Figure 11:
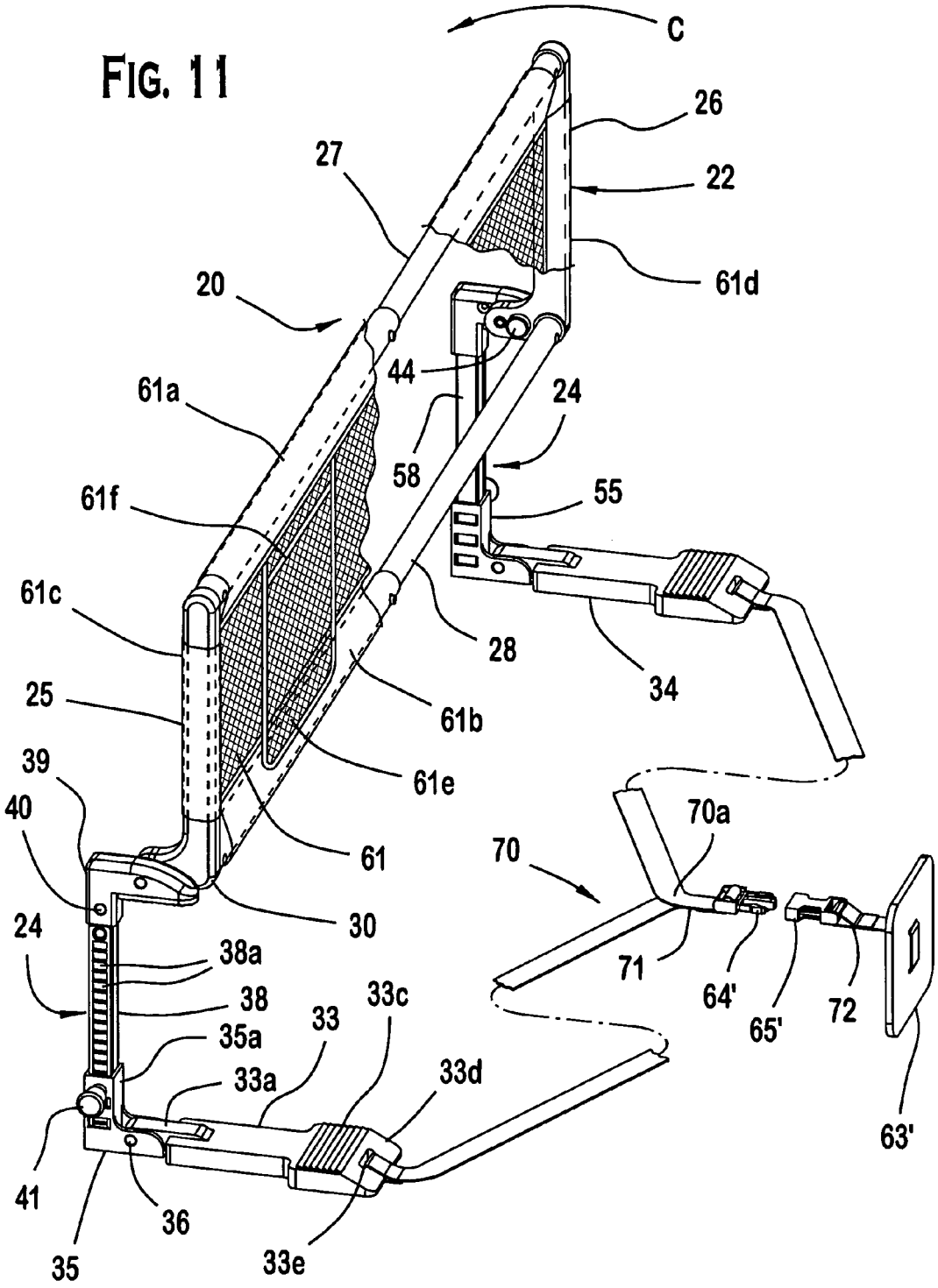
FIG. 11 is a perspective view of an alternative embodiment of the present invention.

The free-end of base member 33 is tapered as shown at 33*d* to facilitate sliding of the base member beneath a mattress and typically between a mattress and a boxspring. A rugged, flexible fabric or plastic web 37 extends through an elongated slot 33*e* provided in the end having a sloping surface 33*d*. Web 37 is provided with a locking element 64 for snap-fitting within a cooperating locking element 65 coupled to one end of a web 62, the opposite end of which is coupled to a preferably flat plate 63 which may be placed against a sidewall of the mattress opposite the sidewall along which the rail is mounted to provide additional means for holding the side rail in place. Alternatively, as is shown in FIG. 11, a Y shaped web 70 may be coupled at one end to base members 33, 34 and at the apex 70*a* to a web 71 provided with a locking member 64' similar to locking member 64. A web 72 is threaded through plate 63' at an end and is coupled to a locking member 65' similar to locking member 65 for releasably locking with locking member 64.

L-shaped bracket 35 (and its mirror image 55) is hollow and has a substantially rectangular-shaped cross-section. The upper end 35*a* telescopingly receives an elongated arm 38 whose upper end extends into a hollow opening a second L-shaped bracket 39, the upper end of member 38 being provided with an opening (not shown) that cooperates with openings on opposite sides of member 39 for receiving fastener 40 to secure members 38 and 39 to one another.

Figure 9:
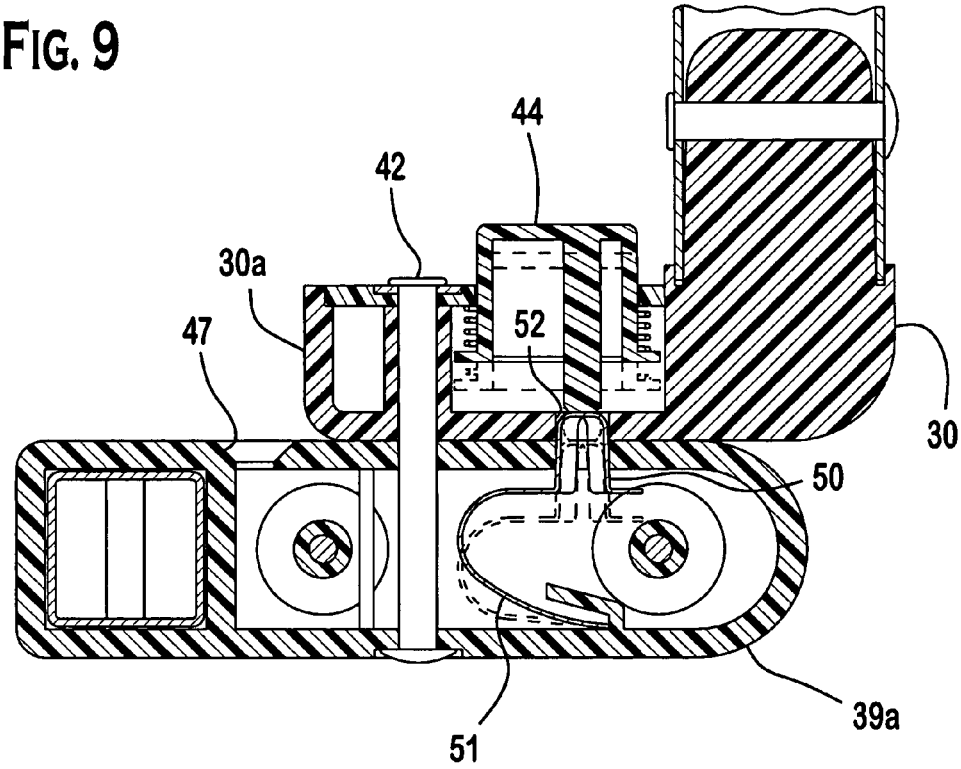
FIGS. 9 and 10 are sectional views of FIG. 7 through the line 9/10—9/10 showing the portion in two different positions.

Member 38 (and its mirror image 58) is also preferably hollow (as shown in FIG. 9), and has a rectangular-shaped cross-section similar to that of the upper end 35*a* of L-shaped bracket 35. Member 38 is slideable within bracket 35. One side surface of member 38 is provided with a plurality of step openings 38*a*. Bracket 35 is provided with a spring loaded locking knob 41 in which an internal bias spring (not shown) normally causes the locking knob 41 to be urged inwardly into bracket 35 in the direction shown by arrow A. Although not shown, the opposite end of locking knob 41 is provided with a tip that mates with and engages an associated one of the openings 38*a*. By lifting or lowering member 38, one of the openings 38*a* may be selected to be aligned with the locking knob 41 which is normally pulled out to permit the member 38 to freely slide with bracket 35. When the member 38 reaches the desired position, locking knob 41 is released, causing its tip to enter one of the openings 38*a* and thereby lock the supporting structure in a selected position.

The arm portion 39*a* of L-shaped bracket 39 (and its mirror image 59), is provided with openings on opposite sides thereof which cooperate with openings on opposite sides of a projecting portion 30*a* of corner bracket 30. The fastening member 42 extends through the openings in projecting portion 30*a* as well as through the opposite sidewalls of bracket portion 39*a* of L-shaped bracket 39 to pivotally couple these members together.

Figure 5:
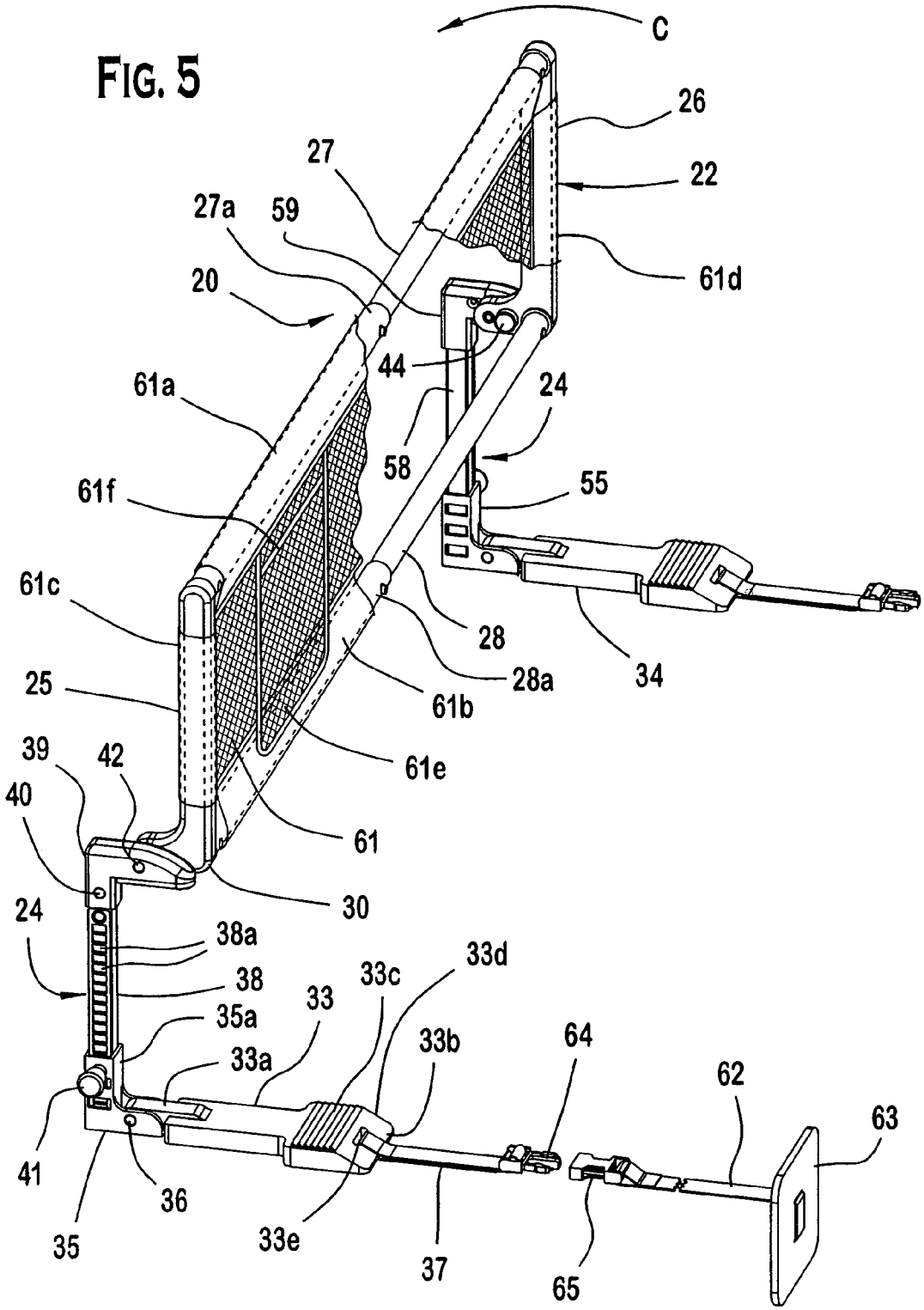
FIG. 5 is a perspective view of the presently preferred embodiment of the present invention.
Figure 7:
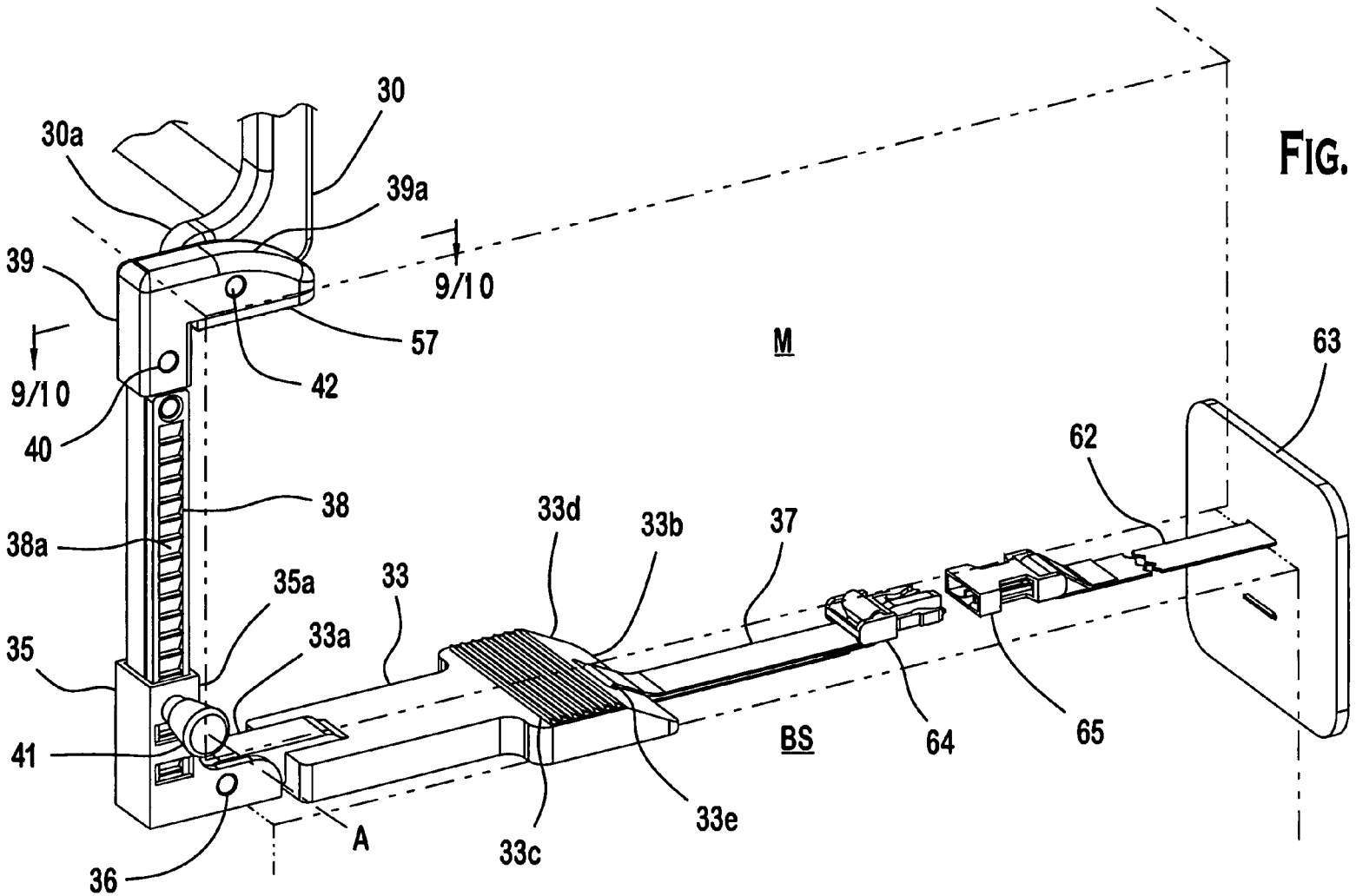
Figure 10:
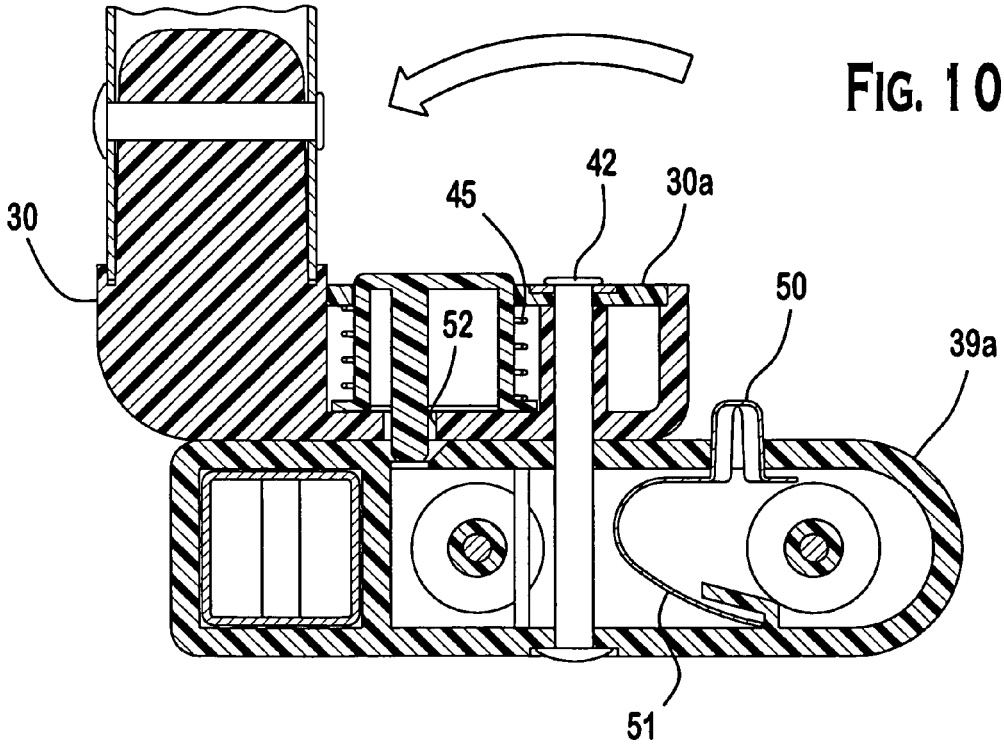

The projecting portion 30*a* has a locking/release button 44 shown in FIGS. 6, 9, and 10. When the rail portion 22 is in the upright position as shown in FIGS. 5 and 7, a locking button 50 that is spring loaded by internal spring bias means 51 (both shown in FIGS. 9 and 10) locks arms 39*a* and 30*a* in the upright position by engaging hole 52 in arm 30*a*. In order to facilitate climbing onto and off of the bed, buttons 44 (on both supporting portions) are pressed in to remove button 50 from the opening 52 in corner bracket 30 to enable rail portion 22 to freely pivot about pivot pin 42, enabling the rail portion to pivot in the counterclockwise direction shown by arrow C in FIG. 5 so as to move the rail portion to a downward position whereby the sides 25 and 26 are substantially aligned with the slideable members 38. In this lowered position, the button 44, which is biased downward by an internal bias spring 45, engaged an angled holding hole 47 that holds the rail in the lowered position. The button 44 can be released from this holding hole 47, allowing the rail portion to be raised by pivoting the rail assembly about pivot members 42. When the rail assembly reaches the upright position, the locking button 50 automatically locks into position through hole 52 by pressing the button 44 back through hole 52. As can be understood, the force exerted by spring 51 attached to the button 50 is greater than that exerted by spring 45 attached to button 44.

As is best shown in FIG. 5, a lightweight and yet rugged netting 61 is placed across the opening in the rail frame formed by members 25, 26, 27 and 28. The netting 61 may be provided with upper and lower sleeves 61*a*, 61*b* which receive the upper and lower crosspieces 27 and 28, the netting being placed upon members 27 and 28 before assembly of the rail portion.

The netting 61 is also provided with side sleeves 61*c*, 61*d* for slideably receiving the side frames 25 and 26. The netting may also be provided with a storage pocket 61*e*, open at its upper end and having a stretchable edge 61*f* for storage, for example, of bed clothing or any other items which a user may desire to place in the pocket.

The upper and lower members 27 and 28 are preferably comprised of a pair of tubular members 27, 27*a* and 28, 28*a*. Members 27 and 28 telescope int members 27*a*, 28*a* to adjust the length of the frame. If desired, the frame members 25, 26 may be similar in design to adjust the height of the rail.

The bed rail is mounted to a bed by placing the base members 33 and 34 beneath a mattress and moving the base members further beneath the mattress until the upright portions of L-shaped brackets 35 and 55 are either in engagement with or nearly in engagement with an adjacent sidewall of the mattress. Each of the locking buttons such as locking button 41 is released, enabling each of the slideable members such as slideable member 38 to be moved downwardly until the mattress is firmly gripped between the undersurface of bracket portion 39*a* and the base member 33. The locking member 41 is released whereby the pin-shaped free end of the locking member enters one of the openings 38*a* to hold the assembly in the desired position preferably at least slightly squeezing the mattress between the undersurface of arm 39*a* and base member 33.

FIG. 7 shows a view of the underside of arm 39*a* of L-shaped bracket 39 as being provided with a pad 57 having a saw-tooth like pattern of V-shaped grooves, further cooperating with base member 33 and the V-shaped grooves, provided there-along to firmly grip the mattress therebetween.

In the event that further holding forces are desired, the fastener 64 coupled to the free end of web 37 may be snapped-fitted into a cooperating locking member 65 coupled to one end of the second elongated web 62 whose opposite end is coupled to an elongated plate 63 which may be positioned to engage a sidewall of the mattress M on the opposite side of the mattress from that along which the rail is mounted. The lower end of member 63 engages a sidewall of a box spring (not shown) thereby holding the bed rail assembly in place. Either web 37 or web 62 or both, are adjustable to adjust the distance between L-shaped bracket 35, engaging one side-wall of the mattress and member 63 engaging the opposite side wall of the mattress. Base member 34 may be provided with a similar structure.

What is claimed is:

1. A bed rail comprising:

a support portion and a rail portion movably coupled to the support portion;

the support portion being adjustable to grip top and bottom surfaces of a member such as a mattress member independently of a position of the movable rail portion; and locking means for releaseably locking the support portion at a desired gripping position.

2. The bed rail of claim 1 wherein said rail portion is pivotally coupled to said support portion and is moveable between an upright position and a released position wherein the rail portion is pivoted toward a sidewall of the mattress member, movement of said rail portion being independent of said support portion.

3. The bed rail of claim 2 further comprising:

second releasable locking means for locking the rail portion to said support portion at at least the upright position.

4. The bed rail of claim 1 wherein said rail portion has a substantially rectangular-shaped frame; and a lightweight rugged net-like member joined to said frame and spanning a hollow region surrounded by said frame.

5. The bed rail of claim 4 wherein said net-like member has elongated sleeves for slideably receiving frame members of said frame to secure the net-like member to the frame.

6. The bed rail of claim 4 wherein said net-like member is a lightweight netting.

7. The bed rail of claim 4 wherein the net-like member is provided with a pocket provided for storage purposes.

8. The bed rail of claim 1 wherein said support portion is comprised of upper and lower L-shaped bracket pairs;

one arm of each of the upper pair of L-shaped brackets being configured for engaging a top of the mattress member and being joined to said rail portion;

elongated members, each having one end joined to the remaining arm of each of said upper L-shaped brackets and having a lower end slideably engaging one hollow arm of an associated one of the lower L-shaped brackets;

said releasable locking means locking each elongated member to one of the lower L-shaped brackets; and a pair of base members, each coupled to a remaining arm of one of the lower L-shaped brackets, each lower arm being configured for engaging a bottom of the mattress member.

9. The bed rail of claim 8 wherein the base members are pivotally coupled to the lower L-shaped brackets by a pivot pin.

10. The bed rail of claim 8 wherein said elongated member has a plurality of openings arranged at spaced intervals along one surface thereof;

wherein said releasable locking means is normally biased in a direction toward said openings and enters one of said openings when aligned therewith; and wherein said releasable locking means is moveable to a releasing position displaced from said openings to enable sliding movement of the elongated member relative to the lower L-shaped bracket.

11. The bed rail of claim 8 wherein each of said elongated members is slidably inserted into a hollow interior of an associated one of said arms of said lower L-shaped bracket.

12. The bedrail of claim 8 wherein each of said elongated members and an associated one of said lower L-shaped brackets is slidably received by the other of said elongated members and an associated arm of said lower L-shaped brackets.

13. The bed rail of claim 8 wherein each base member has a surface for engaging an underside of a mattress, said surface having at least one portion thereof which is provided with a surface configuration that promotes gripping between the mattress and the base member.

14. The bed rail of claim 8 wherein an underside of each of said upper L-shaped brackets has a surface for engaging a mattress, said surface having at least one portion thereof that is provided with a surface configuration that promotes gripping between the mattress member and the L-shaped bracket.

15. The bed rail of claim 14 wherein the surface configuration is a saw-toothed configuration.

16. The bed rail of claim 8 wherein said base members are each pivotally coupled to one of said lower L-shaped brackets and are movable between an extended position for placement beneath a mattress member and a collapsible position with a free end of the base members pivoted toward said upper L-shaped brackets.

17. The bed rail of claim 1 wherein said rail portion is selectively extendible and collapsible.

18. The bed rail of claim 17 wherein said rail portion includes a frame assembly comprised of frame halves that are movable relative to one another to selectively extend and contract said frame.

19. The bed rail of claim 18 wherein a pair of free ends of one of said frame halves is telescopingly received within hollow interiors of a pair of free ends of another one of said frame halves.

20. The bed rail of claim 19 wherein one pair of said free ends are hollow tubular-shaped members.

21. The bed rail of claim 1 further comprising retaining means releasably coupled to said support portion and having at least one retaining plate engaging the mattress member along one side that is opposite another side of the mattress member engaged by said support portion, and a web extending beneath the mattress member for retaining the bed rail against the mattress member.

22. The bed rail of claim 21 wherein said retaining means comprises a flat rigid member adapted to rest against said one side of the mattress member and being coupled to one end of said web, another end of said web being coupled to said support portion.

23. The bed rail of claim 22 wherein said web is an elongated fabric web.

24. The bed rail of claim 23 wherein said web is releasably coupled between said support portion and said retaining means by releasable locking means.

25. The bedrail of claim 1 wherein a lower end of said rail portion is coupled to an upper end of said support portion so as to be positioned inwardly from an adjacent side of the mattress member.

26. A bed rail comprising a support portion and a rail portion secured to the support portion;

the support portion having a pair of lower members being configured for positioning beneath a member such as a mattress member and a pair of upper members joined to said rail portion and configured to engage a top of the mattress member; and said rail portion being pivotally coupled to the upper members of said support portion and moveable, independently of said support portion, between an upright position and a released position wherein the rail portion is pivoted downwardly toward a sidewall of the mattress to facilitate climbing upon and climbing off of the mattress.

27. The bed rail of claim 26 further comprising releasable locking means for locking the rail portion to the support portion in the upright position.

28. The bed rail of claim 27 wherein the releasable locking means includes a push button for unlocking the releasable locking means.

29. A bed rail comprising:

a support portion having an upper and lower generally parallel arms separated by a vertical member that adjusts to define a distance between them, with the lower arm being a greater length than the upper arm;

the vertical member including a locking member that retains the upper and lower arms at the defined distance, whereby portions of said upper and lower arms are configured to respectively engage top and bottom surfaces of a member such as a mattress member to releasably secure the bedrail to the mattress member; and a rail portion of variable area that is pivotally attached to the upper parallel arms for movement between an engaged position and a disengaged position and means for fixing the rail portion in at least the engaged position.

* * * * *